United States Patent [19]

Rood

[11] 3,930,338

[45] Jan. 6, 1976

[54] ACCESS DOOR

[75] Inventor: Ronald A. Rood, Schaumburg, Ill.

[73] Assignee: Arelco, Incorporated, Bridgeview, Ill.

[22] Filed: Feb. 4, 1974

[21] Appl. No.: 439,430

[52] U.S. Cl. ..... 49/465; 52/489

[51] Int. Cl.[2] ..... E05C 21/02; E04F 19/08

[58] Field of Search ..... 49/465, 464, 463, 466, 49/57; 52/499, 502, 480

[56] References Cited

UNITED STATES PATENTS

| | | | |
|---|---|---|---|
| 590,332 | 9/1897 | Palmetier | 49/465 |
| 1,632,431 | 6/1927 | Brown | 49/465 |
| 1,921,051 | 8/1933 | Traut | 49/465 X |
| 2,766,856 | 10/1956 | Nelsson | 49/465 X |
| 3,064,550 | 11/1962 | O'Day et al. | 49/465 X |
| 3,187,389 | 6/1965 | Anderson | 52/489 |
| 3,363,384 | 1/1968 | Rallis | 52/489 |
| 3,491,486 | 1/1970 | Caruth | 49/463 |

*Primary Examiner*—Philip C. Kannan
*Attorney, Agent, or Firm*—Mason, Kolehmainen, Rathburn & Wyss

[57] ABSTRACT

An access door assembly provides a removable covering for an access opening in a wall panel. The assembly includes clip members frictionally mounted to the wall panel at spaced locations around the periphery of the access opening. A door overlies the opening and is dimensioned to cover the clip members as well as the opening. Spring-clip fastening elements releasably secure the door to the clip members and hold the door in position over the opening in the wall panel.

7 Claims, 4 Drawing Figures

ACCESS DOOR

The present invention relates to an improved access door assembly.

In building construction it is a common practice to provide access openings in wall panels in order to permit subsequent inspection and/or repair of apparatus located within the wall, such as for example electrical or plumbing equipment. Such openings are closed by removable access doors of various types.

The simplest variety of access door is a door member attached to the face of the wall panel by means of fasteners such as screws extending through the door and into the wall. This approach has disadvantages including the inconvenience of removing the panel quickly for inspection or repair, and the unsightly appearance of the panel and exposed fasteners.

In order to provide an access door which can be opened quickly and easily, there have been provided access door assemblies including a frame or support portion in addition to the door member. Typically, the door member may be hinged or slideably mounted to the frame portion. In one arrangement of this type, the frame portion is attached to wall studs or other framing members within the wall for support of the door. One disadvantage of such an access door assembly is the labor and difficulty involved in securing the frame or support portion to studs within the wall. Another difficulty, which is particularly acute in installing a door in preexisting wall structures, is the lack of freedom in positioning the access openings since the opening must be located in a predetermined position relative to the wall studs. Yet another disadvantage of this type of door structure is its relatively high expense and the fact that portions of the frame or support portion of the assembly are exposed in the finished installation.

It has been proposed to provide an access door assembly which can be mounted directly to the wall panel rather than to the studs or other framing members. One suggestion has been to provide a door having on its rear surface retaining means directly engageable with the wall panel. This arrangement has proven unsatisfactory because the strain imposed on the wall panel is concentrated in relatively small areas and can result in excessive wear to or destruction of the wall panel, particularly where a fragile material such as drywall or plaster is used. Another approach is to provide a frame or supporting portion fastened to the wall panel. Known structures of this type have been unsatisfactory because of the difficulty of securing the frame portion to the wall panel.

Important objects of the present invention are to provide an access door assembly capable of easily and quickly being installed to cover an opening in a wall panel; to provide an access door assembly of unobtrusive and attractive appearance after installation; to provide an access door assembly capable of being mounted directly to a wall panel rather than to studs or framing members; to provide an access door assembly which does not result in weakening or destruction of the wall panel even after many openings and closings; to provide an access door assembly making possible great freedom in the location of access openings in existing wall structures; and to provide an access door assembly wherein costs due to material, tooling and labor, both in fabrication and in installation, are minimized.

In brief, an access door assembly embodying the features of the present invention may comprise a support structure in the form of a plurality of clips adapted to be mounted to a wall panel at spaced locations around the periphery of an access opening in the panel. The assembly further includes a door of sufficient size to cover the access opening and to cover the clip members. Releasable fastening means are provided to secure the door to the clip members, thereby to releasably mount the door over the access opening.

The invention together with the above and other objects and advantages may be best understood from consideration of the following detailed description of the embodiment of the invention shown in the accompanying drawing, wherein.

Figure 1:
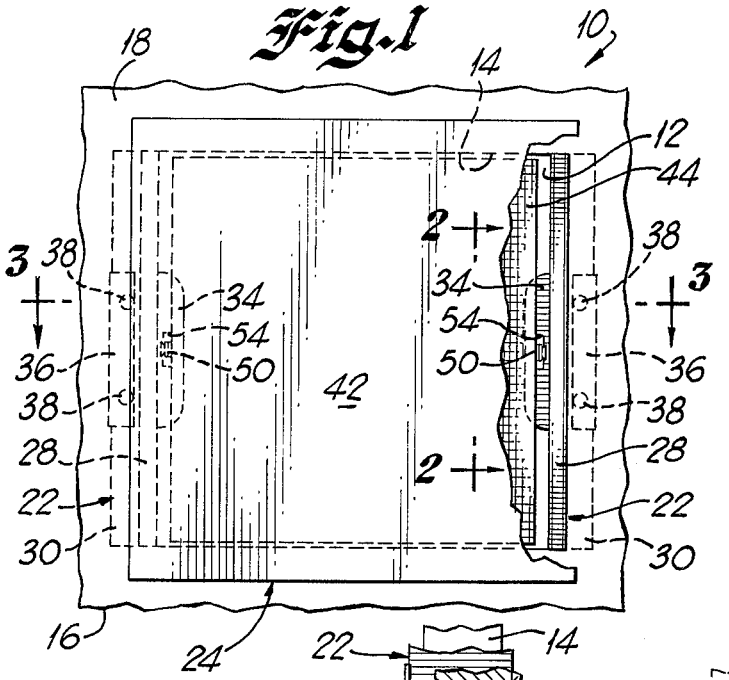
FIG. 1 is a front view, partly broken away, of an access door assembly constructed in accordance with the present invention and installed to cover an access opening in a wall panel.

Referring now to the drawings, there is illustrated an access door assembly designated as a whole by the reference numeral 10 and constructed in accordance with the principles of the present invention. The access door assembly 10 serves to cover and to provide access to an access opening 12 defined by a peripheral wall 14 in a wall panel 16 having an outer surface or face 18 and an inner surface or back 20.

In general, the access door assembly 10 includes a pair of clip members each generally designated as 22 mounted at spaced locations along the peripheral wall 14 defining the access opening 12. The assembly 10 further includes a door structure generally designated as 24 of a size and shape to cover the opening 12 and the clip members 22 when mounted in position. Releasable fastening devices generally designated as 26 serve to secure the door assembly 24 to the clip members 22 after installation of the clip members 22 in the opening 12.

An important feature of the access door assembly of the present invention is that, as in the illustrated embodiment, the outer face of the door assembly 24 may be smooth and imperforate so that its appearance is attractive and unobtrusive after installation. In addition, only the face of the door assembly 24 is visible after installation and not only the access opening 12 but also the securing structure is entirely hidden. Another important advantage is that the securing structure in the form of the clip members 22 may be mounted directly to the wall panel 16 so that the opening 12 can be positioned independently of wall stud positions. Moreover, the clip members 22 can easily and quickly be mounted to the wall panel 16 without the necessity for attaching fasteners, adhesives or the like.

Proceeding now to a more detailed description of the elements of the access door assembly 10, each clip member 22 in accordance with an important feature of the invention is adapted frictionally to engage the wall panel 16 adjacent the edge or peripheral wall 14 defining the opening 12. Consequently, the clip members 22 can be secured to the wall simply by placing them in the desired position.

Each clip member 22 in the illustrated embodiment of the invention comprises a generally U-shaped channel member formed, for example, of sheet metal, plastic or other material. The clip member 22 includes a first or outer flange portion 28 and a second or inner flange portion 30 connected together by means of a bight portion 32. The flanges 28 and 30 are preferably generally parallel to one another and are spaced apart by a distance sufficient to permit the clip member 22 to slide over the wall panel 16 with the outer flange engaging the face 18 and the inner flange 30 overlying the back 20 of the panel 16.

In order to permit mounting of the releasable fastening device 26 to the clip members 22 in a convenient fashion, each clip member is provided with a plate member 34 extending from the bight portion 32 in the opposite direction from the flanges 28 and 30. Consequently, upon mounting of the clip members 22, the plate member extends from the region of the peripheral wall 14 toward the center of the access opening 12. In the illustrated arrangement, the plate member 34 is of shorter length than the clip member 22 and overlies the inner surface of the inner flange portion 30. In order to fasten the plate member 34 to the flange 30, an end portion 36 of plate 34 is bent over to clasp the flange 30.

Figure 3:
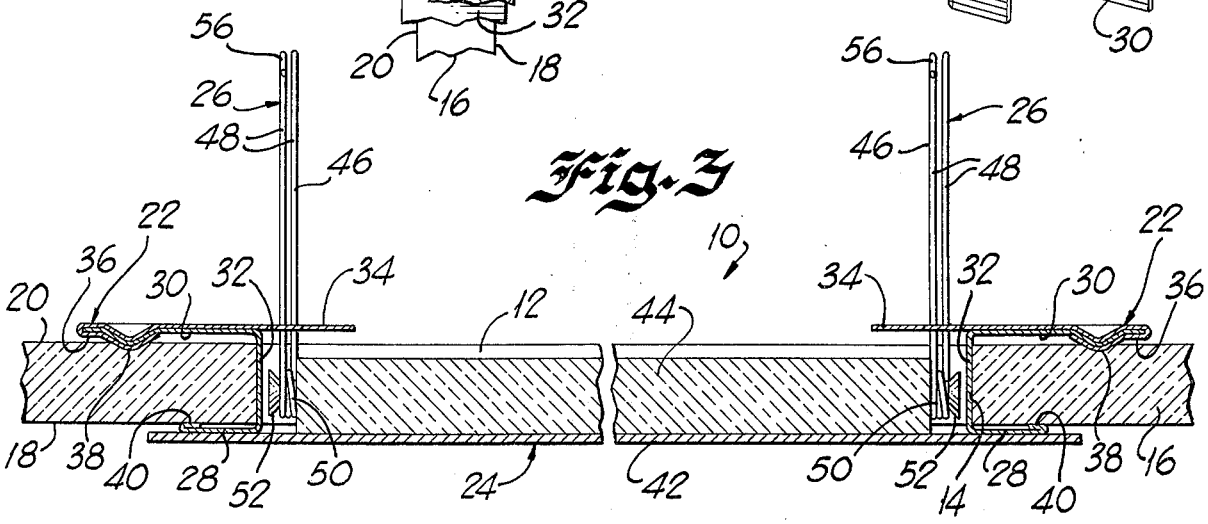
FIG. 3 is an enlarged sectional view taken along the line 3—3 of FIG. 1.

As indicated above, an important feature of the invention is that the clip members 22 are frictionally mounted to the panel 16 and no fasteners, adhesives or other holding mechanism is required. Frictional contact between the clip members 22 and the back 20 of the wall panel 16 is enhanced by means of a pair of protrusions or dimples 38 provided in the inner flange 30. As best illustrated in FIG. 3, the dimples 38 are located in that portion of the flange 30 covered on both sides by the plate member 34 and its end portion 36. Consequently, the dimples 38 also function to reenforce the interconnection between the clip 22 and the plate member 34.

Preferably, as again best seen in FIG. 3, the flanges 28 and 30 are spaced apart slightly further than the thickness of the panel 16. The dimples 38 are raised above the surface of the flange 30 so that the dimples frictionally engage the back 20 of the panel while the outer flange 38 engages the face 18 of the panel. Preferably, the terminal edge of the outer flange 28 is rolled over as indicated by the reference numeral 40 to provide secure gripping of the face of the panel and to prevent the presence of a rough or burred edge in the region of the opening 12 when the door assemly 24 is removed.

In the illustrated embodiment of the invention, the access opening 12 is of generally square or rectangular shape, this being a commonly used access opening configuration. Two clip members 22 are provided. Although the clip members 22 may be shorter if desired, as illustrated, the clip members 22 are substantially the same length as two opposed sides of the opening 12. It should be understood that access door assemblies may be provided of any desired size and shape to cover any type of access opening. In addition, if desired more than two clip members could be used and the clip members may be provided in any size and shape so as to engage the panel adjacent the access opening at any desired number of spaced points.

After mounting of the clip members 22 in the opening 12, the door assembly 24 may easily be installed to cover the clip members 22 and the opening 12. In the illustrated arrangement, the door assembly 24 includes a unitary, smooth and imperforate door panel 42 which may be formed of sheet metal, plastic, wood, or the like, and which may be finished in order to blend with the surrounding face 18 of the wall panel 16. To the back of the door panel 42 there is attached a mounting block portion 44 which may be fabricated of any desired material such as wood, fiberboard or the like. The block 44 serves as a convenient means of mounting the releasable fastening devices 26 and also may serve as an aid in properly locating the door assembly in relation to the opening 12. If desired, the block portion 44 may be formed integrally with the panel 42, or may be replaced by any other suitable structure for mounting releasable fastening devices to the rear surface of the door assembly 24.

Figure 2:
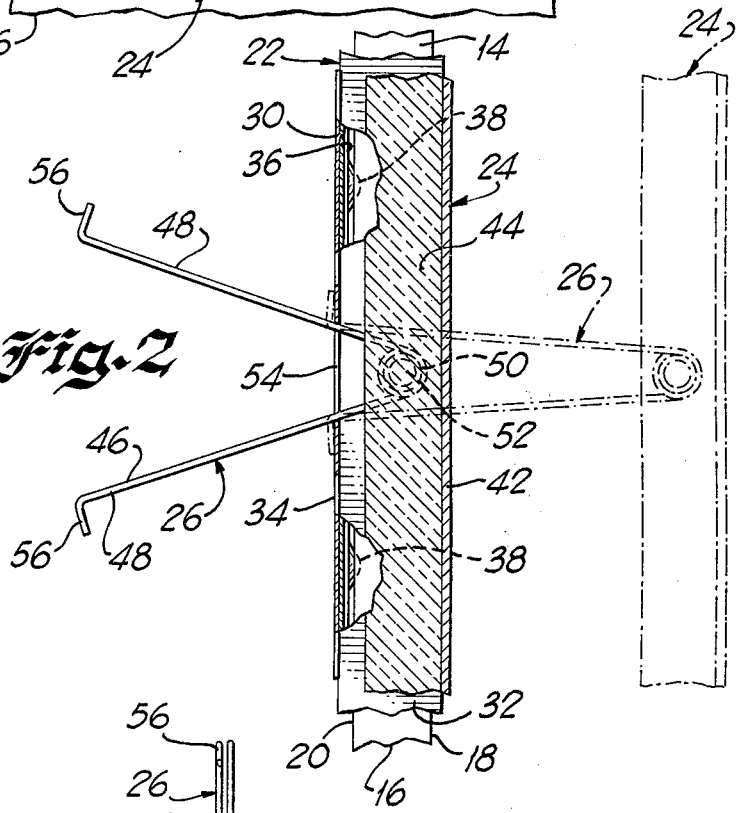
FIG. 2 is an enlarged, fragmentary, sectional view taken along the line 2—2 of FIG. 1.

Each releasable fastening device 26 comprises a spring-clip 46 including spaced leg members 48 extending from a central spring portion 50 and normally assuming a V-shape with the legs somewhat more spread than as illustrated in FIG. 2 of the drawing. Each spring-clip 46 is mounted to the door assembly 24 by means of a fastener 52 holding the spring portion 50 against a side face of the mounting block 44. One fastening device 26 is mounted to the door assembly in alignment with each of the plate members 34 associated with the clip members 22.

Figure 4:
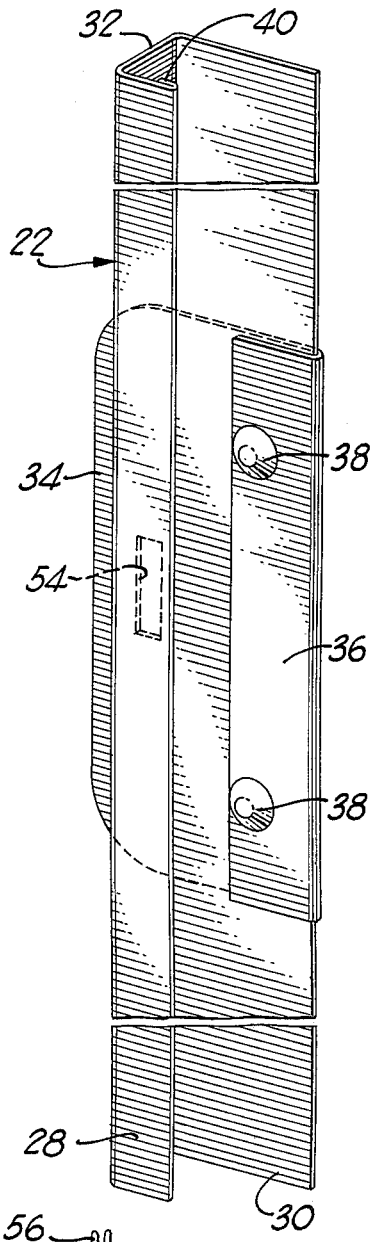
FIG. 4 is an enlarged, contracted, perspective view of one clip member of the access door assembly of FIG. 1.

As best seen in FIGS. 2 and 4, each plate member 34 is provided with a slot 54. In order to mount the door assembly in position, the leg portions 48 of each spring-clip 46 are compressed toward one another so that the ends can be inserted through the slots 54. The position of the door assembly 24 relative to the clip members 22 at this point is illustrated in broken lines in FIG. 2.

After this initial assembly operation, the door assembly 24 is pushed toward the wall panel 16 so that the leg portions 48 slide through the slots 54. In the fully inserted position illustrated in full lines in FIG. 2, the door panel 42 is in position over the face 18 of the wall panel 16, and the legs 48 of the spring-clips 46 are spread in order resiliently and firmly to hold the door assembly 24 in position.

At any time after installation of the door assembly 24, the door assembly may be removed by pulling the door panel 42 away from the wall panel 16. In order to prevent inadvertent and undesirable removal of the door assembly 24 completely from the clip members 22, the ends of the leg portions 48 may be bent over as indicated by the reference numeral 56 to provide an outer stop position. In order to completely remove the door assembly 24 from the clips 22, the leg portions 48 are forced together to permit the bent end portions 56 to move through the slots 54.

Although the clip members 22 are not securely fastened by fasteners, adhesives or the like to the wall panel 16, it should be noted that once the access door assembly 10 is completely installed, the clip members are held in place not only by frictional engagement with the wall panel, but also by the door assembly 24. More specifically, after assembly the clip members cannot move toward the center of the opening 12 because the spring-clips 46 are captured within the slots 54. Thus, the access door assembly 10 is securely held in position after the installation is completed.

Since wall panels are conventionally supplied in varying thicknesses, such as for example one-half inch and three-fourths inch, it may be desired in some instances to install clips 22 on a wall panel thinner than the illustrated wall panel 16. This can readily be done by inserting shim members between the inner flanges 30 of the clips 22 and the back of the panel.

Many modifications and variations of the present invention are possible in light of the above teachings. It should be understood that, within the scope of the following claims, the invention may be practiced otherwise than as specifically described above.

What is claimed and desired to be secured by Letters Patent of the United States is:

1. A removable access door assembly for covering an opening in a wall panel, said access door assembly comprising in combination:

a first member mounted on a first side of said opening and a second member mounted on a second side of said opening, said second side being opposite said first side, and said members not being connected;

each member including flange means for securing said member to the wall panel surface;

a cover plate mounting means supported on each of said members;

a cover plate dimensioned larger than said opening and adapted completely to overlie said opening and said flange means of said members; and a pair of cover plate fastening means extending from the inner surface of said cover plate and engageable with said mounting means for interconnecting said door member and said members.

2. A removable access door assembly as defined by claim 1 wherein each mounting member further includes a protrusion for frictionally engaging the wall panel near the opening.

3. A removable access door assembly as defined by claim 1 which further includes means for securing the cover plate fastening means to the cover plate.

4. A removable access door assembly as defined by claim 3 wherein the means for securing the cover plate fastening means to the cover plate comprises a sheet of rigid material secured to an inside face of the cover plate.

5. A removable access door assembly as defined by claim 4 wherein the cover plate fastening means is a V-shaped spring-clip.

6. A removable access door assembly as defined by claim 5 wherein the V-shaped spring-clip is secured to a cover plate backing member.

7. A removable access door assembly as defined by claim 6 wherein each cover plate mounting means comprises a locking plate member supported by the inner flange means of said mounting member and extending toward the center of the opening, said plate member including slot means for receiving said spring-clip.

* * * * *